US009874024B2

(12) United States Patent
Green

(10) Patent No.: US 9,874,024 B2
(45) Date of Patent: Jan. 23, 2018

(54) BALUSTRADE ANCHOR POST AND BALUSTRADE INSTALLATION METHOD

(71) Applicant: Robert H. Green, Lenoir, NC (US)

(72) Inventor: Robert H. Green, Lenoir, NC (US)

( * ) Notice: Subject to any disclaimer, the term of this patent is extended or adjusted under 35 U.S.C. 154(b) by 0 days.

(21) Appl. No.: 14/924,536

(22) Filed: Oct. 27, 2015

(65) Prior Publication Data

US 2016/0145873 A1 May 26, 2016

Related U.S. Application Data

(63) Continuation-in-part of application No. 13/758,965, filed on Feb. 4, 2013, now abandoned.

(51) Int. Cl.
*E04F 11/18* (2006.01)

(52) U.S. Cl.
CPC ..... *E04F 11/1814* (2013.01); *E04F 11/1812* (2013.01); *E04F 11/1846* (2013.01); *E04F 2011/1821* (2013.01); *E04F 2011/1897* (2013.01); *Y10T 29/49947* (2015.01)

(58) Field of Classification Search
CPC ..... E04F 11/1812; E04F 11/1814; E04F 11/1836; E04F 11/1846; E04F 2011/1885; E04F 2011/1897
USPC ..... 256/59, 65.01, 65.14, 66, 69, 70; 403/262, 298, 359.1, 384; 29/525.01
See application file for complete search history.

(56) References Cited

U.S. PATENT DOCUMENTS 6,141,928 A * 11/2000 Platt ..... E04F 11/1812 256/65.14
6,290,212 B1 * 9/2001 Bartel ..... E04F 11/181 256/59
6,568,145 B2 * 5/2003 Bartel ..... E04F 11/181 256/59
6,719,278 B2 * 4/2004 Bryan ..... E04F 11/181 256/59
7,044,448 B1 * 5/2006 Jones ..... E04F 11/181 256/19
7,475,479 B1 * 1/2009 Ross ..... E04F 11/1812 29/525.01

* cited by examiner

*Primary Examiner* — Josh Skroupa
(74) *Attorney, Agent, or Firm* — Ronald L. Hofer

(57) ABSTRACT

An anchor post for mounting a baluster having a hollow interior onto a supporting surface. The anchor post has a stalk adapted to extend into one end of a baluster and a body adapted to be fastened to a supporting surface. The body has a centrally located downwardly pointed spike for centering the body on a supporting surface.

3 Claims, 5 Drawing Sheets

Fig. 21
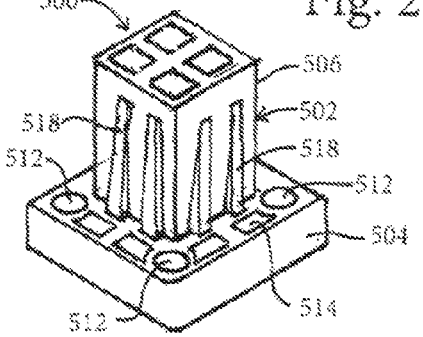
Fig. 22
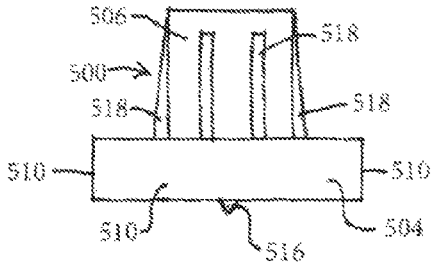
Fig. 23
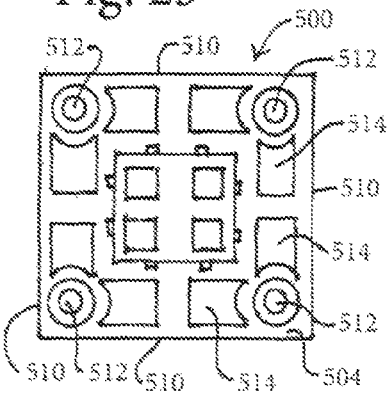
Fig. 24
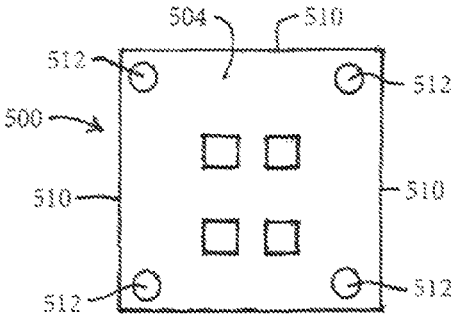
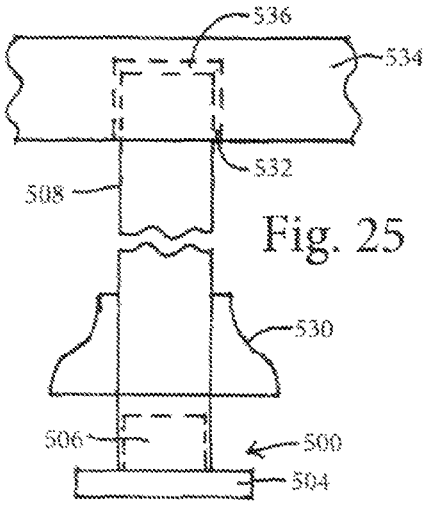
Fig. 25
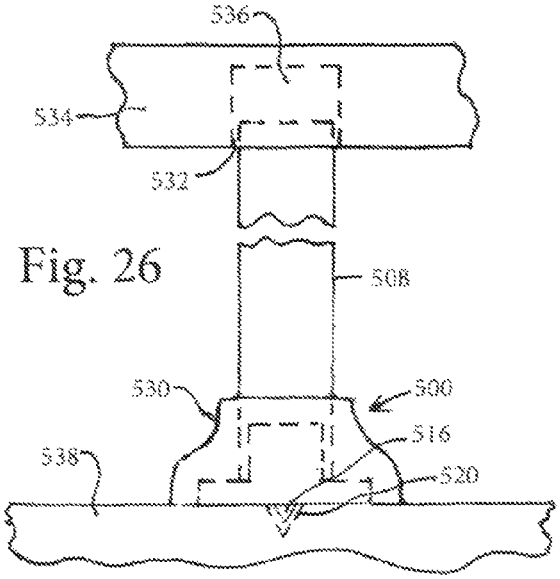
Fig. 26

BALUSTRADE ANCHOR POST AND BALUSTRADE INSTALLATION METHOD

REFERENCE TO RELATED APPLICATION

This application is a continuation-in-part of my co-pending application Ser. No. 13,758,965 filed Feb. 4, 2013.

FIELD OF THE INVENTION

The present invention relates to balustrades. More particularly, the present invention relates to an anchor post for anchoring the end of a baluster and to a method of installation of a balustrade using the anchor post.

BACKGROUND OF THE INVENTION

Hand rail systems known as balustrades are useful and often attractive or decorative architectural features used in buildings and along walkways. Balustrades can provide security or assistance for people walking up or down a stairway or along an elevated walkway. Users can grip the handrail, or bannister, of a balustrade for support to assist in climbing or descending stairs as well as for security against accidentally falling. Balustrades can also improve the aesthetics of a building or other architecture.

Balustrades generally consist of a hand rail supported by a plurality of vertically extending, horizontally spaced supports called balusters. Each baluster is itself supported on, and secured to, a floor or a step of a staircase. Balusters can be made of wood or metal but metal balusters have become popular due to their attractive design features. However the installation of metal balusters is more problematic than the installation of wood balusters and there remains room for improvement in this regard.

Conventional installation of metal balusters involves the use of epoxy resin which is time consuming, requires the handling of chemicals, and can be a messy process. Conventional installation of metal balusters involves drilling a large hole in the tread or floor for each baluster. Also, since each baluster must be accurately located on the floor or step, the installation of metal balusters has generally been left to skilled professional carpenters. Furthermore, even when installed by one with the requisite skill, the installation takes considerable time.

Especially where efficiency and economy are of concern, it would be advantageous if balusters would be installed in a more efficient manner. It would also be advantageous if balusters could be successfully installed by carpenters with limited carpentry talent or even "do-it-yourselfers." As the tolerances allowable for the location of each baluster are small, their installation can be challenging, and it would be advantageous if a device or method were provided which would assist the installer to accurately locate each baluster.

For example, conventional installation of metal balusters is done before painting so that messy epoxy can be covered up by painting the installation. It would be highly desirable to have a method of installation which achieved a good looking result but could be done after painting rather than before painting.

In accordance with the present invention, a novel anchor post and its method of installation is provided to greatly simplify and speed up the installation of hollow metal balusters. The method of the present invention need not be done before painting but can be carried out after painting. Use of an anchor post of this invention facilitates the accurate positioning of each baluster. Power tools such as cordless drivers can be used to easily install each anchor post once it is positioned. Also, it is often a problem in the field that manufactures of hollow metal balusters have slightly different sizes of hollow interiors due to different wall thicknesses or other manufacturing considerations. Therefore, it would be desirable to have an anchor post which can accommodate balusters having slightly varying sizes of hollow interiors.

Further understanding of the present invention will be had from the following specification and claims taken in conjunction with the accompanying drawings.

BRIEF DESCRIPTION OF THE DRAWINGS

FIG. 21 is a perspective view of yet another preferred embodiment of an anchor post of the present invention;

FIG. 22 is a side elevation of the anchor post of FIG. 21;

FIG. 23 is a top plan view of the anchor of FIG. 21;

FIG. 24 is a bottom plan view of the anchor post of FIG. 21;

FIG. 25 is a side elevation, broken away, illustrating the anchor post of FIG. 21 in use installing a balustrade; and FIG. 26 is a side elevation, broken away, illustrating the anchor post of FIG. 21 after its use to install a ballustrade.

SUMMARY OF THE INVENTION

An anchor post for installing and anchoring one end of a baluster of a balustrade. The anchor post has a body adapted to be fastened to a supporting surface such as a stair tread, balcony, knee wall or the like and the anchor post body has a structural member for anchoring one end of a baluster. In one preferred embodiment of this invention, the baluster is a metal baluster with a hollow interior portion and the anchor post has a body with a projection or stalk adapted to extend into and closely fit in, a hollow interior of an anchor post, and a spike adapted to locate the anchor post on a support surface. The anchor post body has at least one through bore for a fastening element for attaching the body to a support surface such as a stair tread, balcony or knee wall, and the anchor post has a body having side surfaces presenting outwardly diverging ridges which accommodate variances in sizing of the hollow interior of metal balusters.

DESCRIPTION OF THE INVENTION

Figure 1:
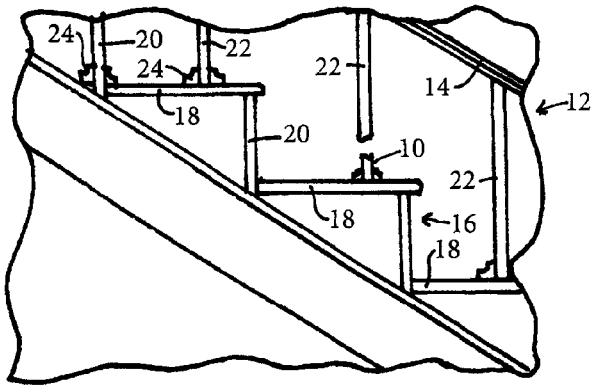
FIG. 1 is a side elevation, broken away, of a stairwell showing a balustrade comprising a preferred embodiment of an anchor post of the present invention.
Figure 2:
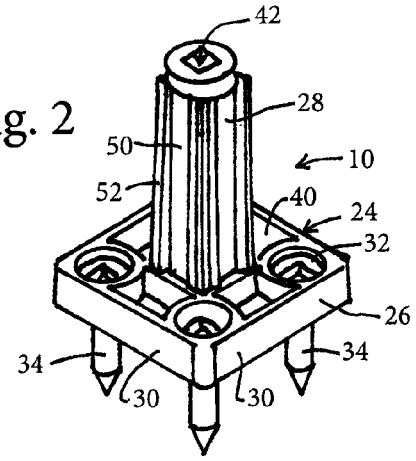
FIG. 2 is a perspective view of the anchor post shown in FIG. 1.
Figure 4:
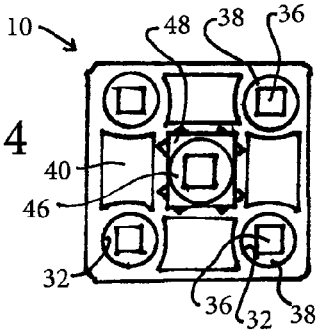
FIG. 4 is a bottom plan view of the anchor post of FIGS. 1, 2 and 3.
Figure 3:
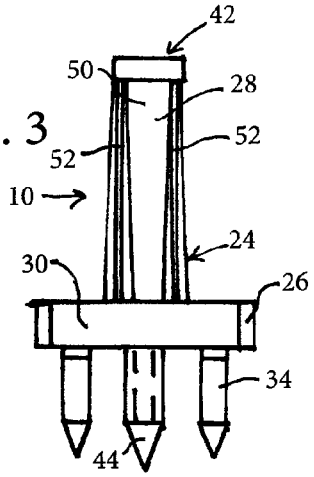
FIG. 3 is a side elevation view of the anchor post of FIGS. 1 and 2.
Figure 5:
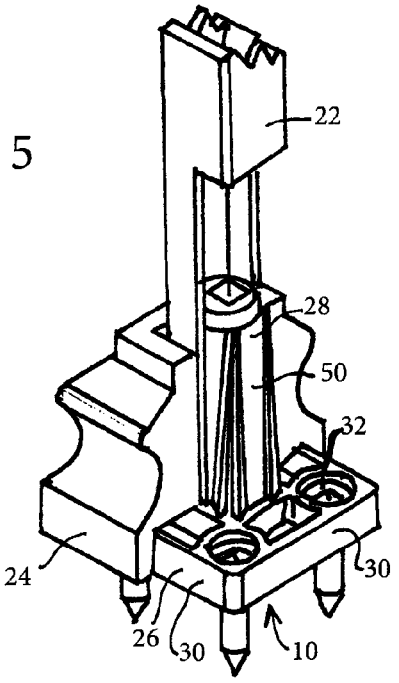
FIG. 5 is a perspective view, broken away, showing the anchor post of FIGS. 1, 2, 3 and 4 in association with the shoe and baluster of the balustrade of FIG. 1.

Now referring to FIG. 1, a preferred embodiment of a balustrade anchor post of the present invention is shown and indicated generally by the numeral 10. In FIG. 1 a plurality of anchor posts 10 are shown in use with a typical stair case balustrade indicated by the numeral 12. Except for the use of anchor posts 10 of the present invention, balustrade 12 is illustrated in FIG. 1 as comprising conventional components: hand rail 14 for staircase 16 which has stairway treads 18 and risers 20. Hand rail 14 is supported by a plurality of vertically extending, horizontally spaced, iron balusters 22 which are themselves anchored by anchor posts 10 secured to treads 18. The lower portion of each baluster 22 is covered by a decorative shoe 24 as is conventional in the art.

The details of anchor post 10 are shown in FIGS. 2-5. Anchor post 10 generally has a body 24 with a flange 26 having a projection 28 extending generally upwardly from flange 26 as viewed in the Figures.

Flange 26 provides a base for anchor post 10 so that it can be secured to a supporting surface such as a stair tread, balcony, or the like. Projection 28 provides a post or stalk for anchoring hollow baluster 22. Flange 26 and projection 28 are integral parts of body 24 and are preferably molded from a thermoplastic or thermoset polymeric material as a one piece unit. Flange 26 is shown as having sides 30 of equal length and, hence, has a generally square shape in plan view. Flange 26 also has four bores 32 which are countersunk and extend through flange 26. A threaded fastener 34 extends through each bore 32 for securement of flange 26 to tread 18 or other desired support surface. Each fastener 34 has a round pan head 36 which can be driven against shoulder 38 of countersunk bore 32 to hold flange 26 against tread 18. Apertures or cutouts 40 are provided in flange 26 to save material and weight.

Projection 28 extends from flange 26 in the direction of the associated elongated baluster 22, generally upwardly as viewed in the Figures. Projection 28 is an elongated post or shaft with a square cross-section shape generally corresponding to the internal size and cross-section shape of the baluster it is intended to anchor. A longitudinally extending, countersunk bore 42 extends through the center of projection 28 and is adapted to carry a center, threaded fastener 44 for securing anchor post 10 to tread 18 as described in further detail below in the description of the installation of balustrade 12 using a plurality of anchor posts 10. Each fastener 44 has a head 46 for driving fastener 44 and each bore 42 has a shoulder 48 against which head 46 exerts clamping force when fastener 44 is screwed into tread 18 to hold anchor post 10 against tread 18. Projection 28 has four side walls 50, each of which carries a pair of spaced apart ridges 52 which extend the length of each side wall and are upwardly tapered. It is intended that ridges 52 will provide a tolerance feature to each anchor post 10 by accommodating slightly different sizes of balusters 22. It will be appreciated by those skilled in the art that hollow metal balusters may have a stated size but that some variation in actual size of their interior dimensions will occur in actual practice due to differences in wall thickness or manufacturing methods. Ridges 52 provide tolerance to such variation as described in further detail below in the description of the installation balustrade 12 as described below in the description of the installation of balustrade 12.

Of course, it will be appreciated by those skilled in the art that anchor post 10 is subject to variation and modification within the broad scope of the present invention. For example, sides 30 of flange 26 could be of different lengths so that flange 26 could have any desired plan view shape such as rectangular, round, or oval. The number of bores 32 through flange 26 could be more or less than four and the heads 36 and 46 of threaded fasteners 34 and 44 can be of any suitable shape such as round Phillips, Torx, slotted or other fastener heads. Also, flange 26 and projection 28 can be made of two separate pieces which are secured together by adhesive or other fastening means and can be comprised of any suitable material. Projection 28 of anchor post 10 can have other than a square cross-section shape and ridges 52 can be greater or fewer or even none if suitable fit with baluster 22 is obtained. Also, anchor post 10 can be used in conjunction with stair treads, balconies, or any other desired support surface.

During the method of installation of balustrade 12, the position of the center of each baluster is marked or otherwise noted on the relevant stair tread 18. Then a hole is drilled at each mark or noted location. Each anchor post 10 is installed in the correct location by screwing center fastener 44 which extends through the center of bore 42 of projection 28 into the hole. This step holds anchor post in place and can be conveniently and quickly carried out by use of a powered driver with a driving means appropriately matching the head 46 of center fastener 44. Next, the four fasteners 34 are positioned and driven to secure flange 26 in position on tread 18 to keep flange 26 from rotating about the longitudinal axis of projection 28. A power driver can also be used for this step. For convenient installation, anchor post 10 can be provided to the installer as a kit including center fastener 44 and fasteners 34.

Once anchor post 10 is secured in place on tread 18 with threaded fasteners 44 and 34, balustrade 22 can be slipped down over projection 28 to flange 26. It is contemplated that tapered ridges 52 will be shaved by the lower edges of baluster 22 during this step to provide a close fit between projection 28 and the hollow interior of baluster 22. Finally, shoe 24 can be slipped down baluster 22 into position over anchor post 10 and held or secured in position by a set screw (not shown in the figures) or any other suitable securing means.

The balustrade system of the present invention offers several advantages in installation. The present invention provides an anchor post especially well adapted for use in the installation of hollow metal balusters. The anchor post of this invention can be provided in a few different sizes each of which can then accommodate slight variations in a stated size of hollow interiors baluster. Also the anchor post of the present invention can be easily and quickly installed. The anchor post of this invention is readily adapted to be accurately positioned and quickly secured to the tread of a stairwell or the like using power drivers. The use of messy epoxy is avoided and the installation method is faster than a method using epoxy. The installer does not have to drill a relatively large hole in the tread. The present method provides a strong method of installation of hollow iron balusters.

Figure 6:
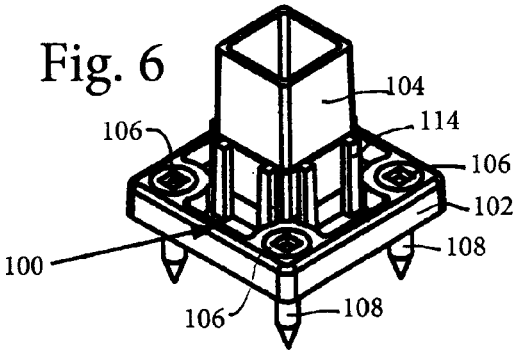
FIG. 6 is a perspective view of an alternative preferred embodiment of an anchor post of the present invention.
Figure 7:
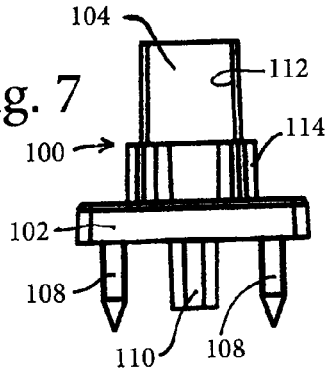
FIG. 7 is a side elevation view of the anchor post of FIG. 6.

Now referring to FIGS. 6 and 7, an alternative preferred embodiment of an anchor post of the present invention is shown and indicated generally by the numeral 100. Anchor post 100 is adapted to accommodate either a solid or a hollow baluster and has a flange 102 with a hollow projection 104 extending generally upwardly from flange 102 as viewed in the Figures. Flange 102 has four countersunk bores 106 for threaded fasteners 108 for securement of flange 102 to a stair tread or the like. Flange 102 also has a post 110 extending downwardly and which is intended to fit into a center hole drilled by the installer in the tread for accurately locating anchor post 100. Projection 104 has a hollow interior 112 into which a solid baluster can be inserted. Alternatively, if a hollow iron or other hollow metal baluster is to be used, projection 104 has a plurality of tapered ridges 114 which are analogous to ridges 50 of anchor post 10. Thus, it is contemplated that ridges 114 will extend upward into the lower end of the hollow baluster.

Figure 8:
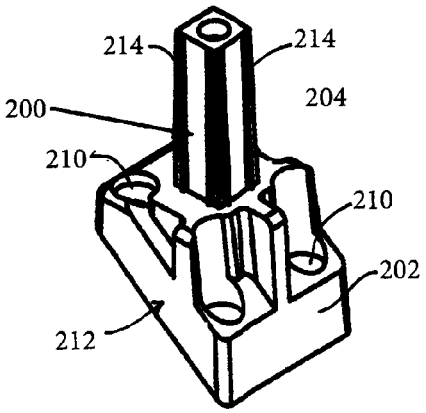
FIG. 8 is a perspective view of another alternative preferred embodiment of an anchor post of the present invention for use with a knee wall.
Figure 9:
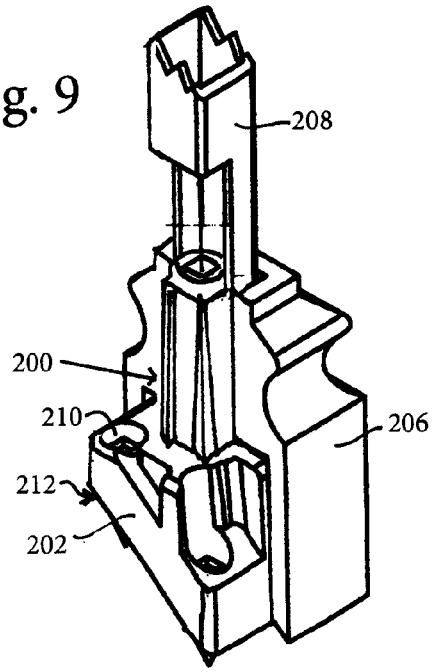
FIG. 9 is a perspective view of the anchor post of FIG. 8 in association with a shoe and baluster, shown broken away.
Figure 11:
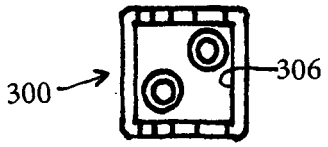
FIG. 11 is a top plan view of the anchor post of FIG. 10.
Figure 10:
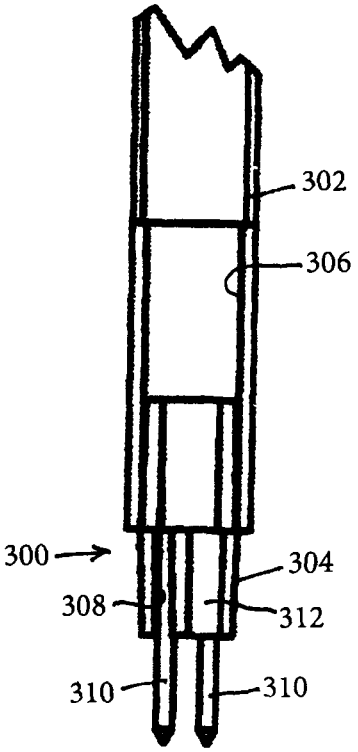
FIG. 10 is a perspective view of an alternative preferred embodiment of an anchor post of this invention designed for use without a shoe, the anchor post shown with a hollow baluster, broken away.
Figure 12:
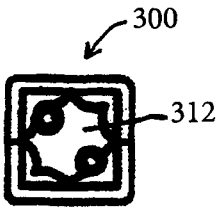
FIG. 12 is a bottom plan view of the anchor post of FIG. 10.
Figure 13:
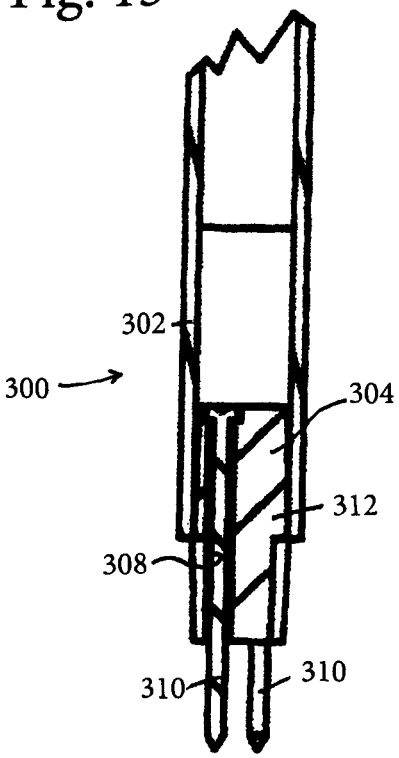
FIG. 13 is a sectional view taken along line 13-13 in FIG. 10 with the baluster shown broken away.
Figure 14:
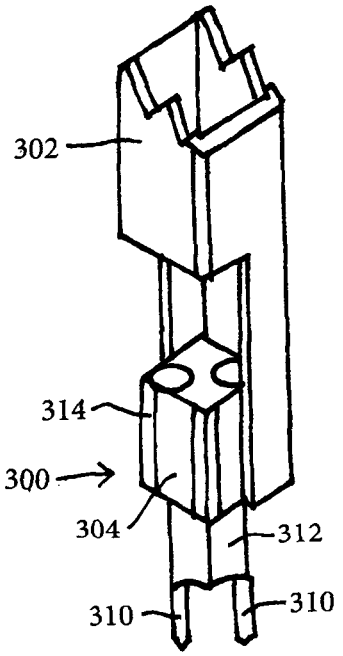
FIG. 14 is a perspective view of the anchor post of FIG. 10 in with the baluster shown broken away.
Figure 15:
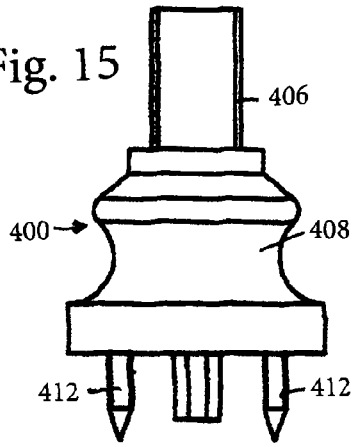
FIG. 15 is a side elevation view of another alternative preferred embodiment of an anchor post of the present invention shown with a shoe and a solid baluster, broken away.
Figure 16:
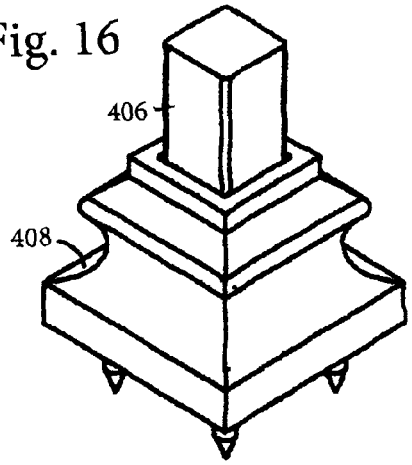
FIG. 16 is a perspective view of the anchor post of FIG. 15 with a shoe and a solid baluster broken away.
Figure 17:
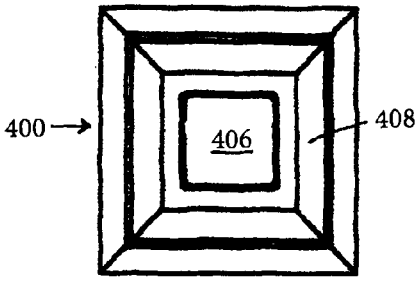
FIG. 17 is a top plan view of the anchor post of FIG. 15.
Figure 18:
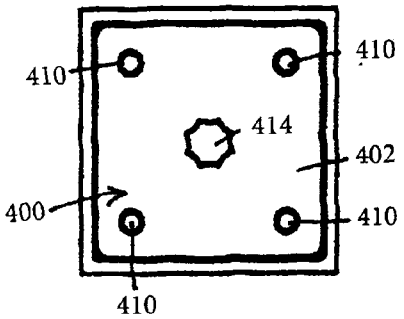
FIG. 18 is a bottom plan view of the anchor post of FIG. 15.
Figure 19:
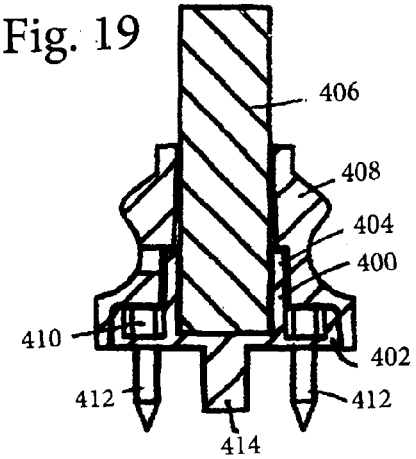
FIG. 19 is a sectional view taken along line 19-19 in FIG. 15.
Figure 20:
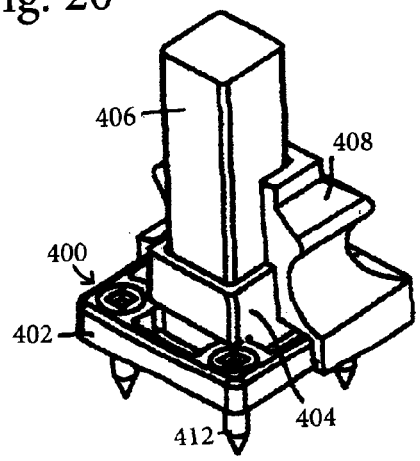
FIG. 20 is a perspective view of the anchor post of FIG. 15 with a solid baluster broken away.

Now referring to FIGS. 8 and 9, another alternative embodiment of an anchor post of the present invention is shown and indicated generally by the numeral 200. Anchor post 200 has a flange or base 202 and a projection 204 and is shown in FIG. 9 with shoe 206 and baluster 208. Base 202 has bores 210 and is analogous to flange 26 of anchor post 10 but has an angled bottom surface 212 and is adapted for mounting on a knee wall or other surface from which the associated baluster does not extend at a right angle. Projection 204 is analogous to projection 28 of anchor post 10 and has ridges 214 which are analogous to ridges 52 of anchor post 10.

Yet another alternative preferred embodiment of this invention is shown in FIGS. 10-14 and indicated generally by the numeral 300. Anchor post 300 is designed for use with a hollow baluster and provides an anchor post which can be used without a shoe. Thus, anchor post 300 is entirely concealed from view after its installation by its associated hollow baluster 302 which fits over anchor post 300. As shown in the Figures, anchor post 300 has a relatively small footprint and generally comprises a body 304 which has a shape and size to fit closely inside hollow interior 306 of baluster 302. Body 304 has a pair of countersunk bores 308 for fasteners 310 for securing body 304 to a stair tread or the like. The lower part of body 304 has a down post 312 extending downwardly therefrom and adapted to fit into a locating hole drilled in the tread by the installer. Ridges 314 on body 304 are analogous to ridges 52 of anchor post 10.

The installation of anchor posts 300 is particularly straightforward. Once the center of each desired location of each baluster is located and marked on a stair tread or other desired supporting surface, holes for down posts 312 are drilled at the marks and a down post 312 is inserted into each hole. The respective anchor posts 300 are secured by screwing fasteners 310 into the tread or surface and then a hollow baluster 302 is slid down over each anchor post 300. Ridges 314 serve to closely fit each baluster on each anchor post 300.

FIGS. 15-20 illustrate still another alternative preferred embodiment of the present invention, anchor post 400. The alternative embodiment anchor post 400 is designed and well adapted for use with either a solid or hollow baluster. Anchor post 400 generally comprises flange 402 and projection 404 and is shown in use with solid baluster 406 and shoe 408. Flange 402 has four countersunk bores 410 for threaded fasteners 412 and has an optional central post 414 which is intended to be inserted into a hole drilled by the installer in the tread or other supporting surface to facilitate installation of anchor post 400. Projection 404 of anchor post 400 has a hollow interior 416 which is sized and shaped to closely receive the lower part of baluster 406. Hollow interior 418 of shoe 408 is also designed to fit snugly against anchor post 400 and baluster 406 so that baluster 406 cannot easily move. An optional set screw (not shown in the figures) can be used to penetrate the wall of shoe 408 to tighten it to the outside of anchor post 400 and baluster 406.

Now referring to FIGS. 21-26, yet another preferred embodiment of the present invention is shown and indicated generally by the numeral 500. Anchor post 500 is particularly well adapted for efficient, after painting installation of balusters in a balustrade system.

Generally speaking anchor post 500 generally has a body 502 with a generally horizontal flange 504 and a generally vertical stalk 506. Stalk 506 extends generally upwardly from flange 504 as viewed in the Figures.

Flange 504 provides a base for anchor post 500 so that it can be secured to a supporting surface such as a stair tread, balcony, or the like. Stalk 506 provides a post or stalk for anchoring a hollow metal baluster such as baluster 508 illustrated in FIGS. 25 and 26 which illustrate the installation of a balustrade using anchor post 500 and is described in more detail below. Flange 504 and stalk 506 are integral parts of body 502 and are preferably molded from a thermoplastic or thermoset polymeric material as a one piece unit. Flange 504 is shown as having sides 510 of equal length and, hence, has a generally square shape in plan view. Flange 504 also has four bores 512 which are countersunk and extend through flange 504 to facilitate securement of flange 504 to a tread or other desired support surface. Numerous apertures or cutouts 514 are provided in flange 504 to save material and weight.

Stalk 506 extends upwardly from flange 504 and is intended to be inserted into one end of an associated elongated baluster 508. Stalk 506 is an elongated post or shaft with a square cross-section shape generally corresponding to the internal size and cross-section shape of the baluster it is intended to anchor. Of course, the cross-sectional shape of stalk 506 can be changed to conform to any baluster having a different cross-sectional internal shape. A longitudinally extending spike 516 extends downwardly from the bottom of flange 504 at the center thereof and is adapted to locate the center of anchor post 500 on a tread or the like as described in further detail below in the description of the installation of a balustrade using a plurality of anchor posts 500.

It is intended that ridges 518 will provide a tolerance feature to each anchor post 500 by accommodating slightly different sizes of balusters. It will be appreciated by those skilled in the art that hollow metal balusters may have a stated size but that some variation in actual size of their interior dimensions will occur in actual practice due to differences in wall thickness or manufacturing methods. Ridges 518 provide tolerance to such variation so that stalk 506 will be tightly fit into the hollow interior of the baluster it is intended to secure.

A preferred method of installation of a balustrade using anchor posts 500 is carried out as follows. It will be appreciated by those skilled in the art that the method can be carried out after the balustrade has been stained and/or painted and the handrail installed. After "painting" installation offers a great advantage to professional contractors. Generally speaking, a contractor will employ a painting crew to paint a new home or business, then install the balustrade system, and then call the painters back to stain or paint the balustrade. It is a great advantage of the present method that the method can be carried out after painting since the balustrade parts can be painted or stained before installation.

In accordance with the method of this invention, small holes 520 are made at the center point of the desired location for each baluster by means of a nail, nail punch or the like. Each hole is intended to receive and center a spike 516 of anchor post 500. Of course, the location of each hole can be pre-determined and marked in any conventional manner.

Next balusters are are provided and, if necessary, cut to length. Shoes are usually desired for a professional look and, if so, they should be put onto each baluster and briefly tightened a few inches up the baluster. Each anchor post 500 is mounted onto the lower end of each baluster. The anchor post is intended to be a tight fit and can be mounted, for example, by tapping with a soft wood block or the like without damaging the spike on the anchor post. Then the top of the balusters are inserted into respective holes in the handrail. Each hole in the handrail has "headroom" as indicated by numeral 536 to thereby allow the end of the baluster to extend into the hole so that the baluster can be freely positioned between the handrail and the supporting surface 538. As illustrated in FIG. 25, shoe 530 has been placed onto baluster 528 and stalk 506 of anchor post 500 has been inserted into one end of baluster 508. The opposite end of baluster 508 has been inserted into hole 532 in hand rail 534 and extended upwardly into headspace 536. Hole 532, preferably has a cross-sectional shape corresponding to the cross-sectional shape of baluster 508.

Next, the bottom of each baluster is placed over the nail holes and each spike of each anchor post is centered and placed in the desired nail hole. A straight edge may be used to ensure that the anchor posts are square to each other and in alignment. Then screws are turned in through at least two bores 512 to anchor each anchor post to the tread or supporting surface. Preferably two screws are inserted through opposite corner apertures in the flange of each anchor post. Finally, shoes 530 are dropped down over each anchor post 500 to complete the installation While preferred embodiments of the present invention have been illustrated and described herein, it will be appreciated by those skilled in the art that the present invention is subject to variation and modification within the broad scope of the invention and it is intended that the present invention will be limited only by the scope of the following claims.

What is claimed is:

1. An anchor post for mounting one end of a hollow baluster, the anchor post comprising:

a body having a flange and a stalk, said flange adapted to be fastened to a supporting surface, said stalk adapted to extend into said one end of said baluster, said body having a centrally located spike for centering said body on the supporting surface, wherein said flange comprises apertures therein for fastening elements, said stalk has sides with diverging ridges, and wherein said anchor post is monolithically formed from polymeric plastic material.

2. A balustrade system comprising:

a plurality of balusters supporting a handrail, each of said balusters being mounted to a supporting surface by an anchor post, each said anchor post comprising:

a body with a flange fastened to said supporting surface, and a stalk extending into an end of one of the plurality of balusters, each said body having a centrally located spike for centering said body on said supporting surface, said stalk of said body has a pair of diverging ridges on each side thereof, said anchor post is monolithically formed from polymeric plastic material, said flange of said body has apertures therethrough for fastening elements, and said stalk of said anchor post has generally vertically extending sides with a pair of diverging ridges on each of said sides.

3. A method of installing a balustrade system on a supporting surface, said system comprising a plurality of balusters and a hand rail, the method comprising the steps of:

providing an anchor post, said anchor post having a body with a flange adapted to be fastened to a supporting surface and a stalk adapted to extend into said one end of a baluster, said body having a centrally located spike for centering said body on a supporting surface;

making indentations at desired locations on said supporting surface;

placing a shoe on one end of each baluster;

mounting an anchor post on each said one end of each baluster;

inserting an opposite end of each baluster into a respective hole in said handrail;

locating each said spike in an associated indentation;

securing each said anchor post to said supporting surface by fastening each said flange to said supporting surface; and dropping each said shoe down over each said anchor post, wherein said anchor post is monolithically formed from polymeric plastic material, said flange of said body has apertures therethrough for fastening elements, and said stalk of said anchor post has generally vertically extending sides with a pair of diverging ridges on each of said sides.

* * * * *